United States Patent [19]

Oshima et al.

[11] Patent Number: 4,995,478

[45] Date of Patent: Feb. 26, 1991

[54] START COMPENSATION DEVICE FOR ELEVATORS

[75] Inventors: Kenji Oshima, Narita; Yasutami Kito, Tokyo, both of Japan

[73] Assignee: Otis Elevator Company, Farmington, Conn.

[21] Appl. No.: 340,987

[22] Filed: Apr. 20, 1989

[30] Foreign Application Priority Data

Apr. 21, 1988 [JP] Japan ..... 63-99227

[51] Int. Cl.[5] ..... B66B 1/30

[52] U.S. Cl. ..... 187/115

[58] Field of Search ..... 187/115

[56] References Cited

U.S. PATENT DOCUMENTS 4,828,075 5/1989 Klingbeil et al. ..... 187/115

*Primary Examiner*—A. D. Pellinen

*Assistant Examiner*—W. E. Duncanson, Jr.

*Attorney, Agent, or Firm*—Breffni X. Baggot

[57] ABSTRACT

An elevator starting compensation device for performing starting compensation with addition of a load detection signal and a torque command signal comprising a speed command circuit, an automatic speed regulator amplifier for outputting the torque command signal, and a load detecting element for detecting load of a passenger cage, characterized in that it further includes a static frictional torque compensating element inputting a load detection signal and travel (lifting and lowering) signal and outputting a static frictional torque compensation signal predetermined according to the magnitude of the sensed passenger load, the torque compensation signal being added to the torque command signal so that start-up of actual speed is not delayed with respect to the speed command.

1 Claim, 3 Drawing Sheets

START COMPENSATION DEVICE FOR ELEVATORS

DESCRIPTION

1. Technical Field

This invention relates to a starting compensation device for an elevator.

2. Background Art

An elevator is constituted by a passenger cage, drive mechanism, a balance weight, and other members, with the balance weight typically balancing the elevator when the passenger cage is occupied by people constituting 50% of the riding capacity Torque required by the drive mechanism in that case is only half of the torque corresponding that required at rated load, if the torque corresponding to the fly wheel effect (polar moment of inertia or $GD^2$) of the mechanical system for acceleration and deceleration is left out of consideration. Thus, usually the required torque is proportional to the amount of passengers with 50% of the balance weight as a center. In a control for such an elevator, follow-up automatic speed control (ASR) control is based on a command from a speed command circuit which generates a speed pattern signal, and the speed control is executed with starting compensation by adding a compensating torque signal in proportion to a sensed signal indicative of passenger load to a torque command which is an output of the ASR amplifier.

The rotational speed of some motors of elevators is changed by means of gears, and that of others is not changed by gears. In elevators of the latter case, which are so-called "gearless" machines, the machine efficiency is high, and irrespective of lifting and lowering, the relationship between the balance weight and torque is effective, so that smooth starting is ensured. However, in the former case, or in the geared machine, the gear efficiency is a consideration, and therefore torque for loss due to gears in addition to torque for passenger load is required. Hence, in order to start the elevator at a comfortable speed, it is necessary to smoothly control velocity changes at the time of starting the elevator and, more specifically, to release the mechanical brake and to suppress torque fluctuation at the beginning of acceleration by a drive system torque Accordingly, usually after the load of passengers is detected by a load detection section in the drive system so as to allow the motor to generate torque adequate for load beforehand, acceleration of the elevator starts with the mechanical brake released and the load of the cage sustained by the motor torque. However, in the geared machines, since gears have large static frictional resistance, vibration (starting shock) is produced at start. FIG. 4 shows chronological change of speed, torque and the like in a case where vibration occurs at start; FIG. 4(A) shows a speed characteristic, in which the solid line a indicates desired speed although, in an actual case as indicated by the dotted line b the slope as the elevator moves after starting has a large inclination due to a delay after the start command. FIG. 4(B) shows a torque characteristic using the same time line, depicting that the elevator starts with bias torque c which happens to be inadequate for the particular load and only starts moving at the time indicated by line b in FIG. 4(A) when torque d finally reaches a level at which it can overcome the static friction of the gear. FIG. 4(C) is an acceleration characteristic, in which the desired curve is indicated by the dotted line e although the vibration indicated by the solid curve f occurs in the actual case since the elevator starts suddenly.

Thus, in control systems of the above described type, even if load detection is performed, it is likely that actual start is delayed relative to the speed command due to losses in the gears (particularly due to static frictional torque) as shown in FIG. 4, resulting in vibration at start (so-called starting shock), so that a smooth start characteristic is never realized. Therefore, in such control systems a problem remains, namely the start characteristic is in good shape at some occasions while it is not on other occasions. Moreover, the lag at actual start cannot be neglected in an elevator system which is influenced by various vibration factors even if it is small. But if the response of the control amplifier is quickened in order to avoid that, oscillation between the mechanical members and the drive system members will occur.

When the geared machines are utilized in low speed machines, no problems appear in actual cases. However, for higher speed machines used for luxury elevators using geared machines, where an inverter is typically employed as the drive source, the necessity arises to reduce the starting shock. However, in conventional elevator control systems, even if the load detection is conducted for start compensation, the starting shock set forth above occurs in responding to the speed command in an actual case since there is no measure for the static frictional torque.

DISCLOSURE OF INVENTION

An object of the present invention is to provide an elevator control system which operates with almost no lag between the speed command and the actual starting of the elevator car by employing compensation for static frictional torque.

According to the present invention, elevator starting compensation is provided by detecting a load proportional to the varying load of a passenger cage and adding a detection signal corresponding to the load to a torque command signal, the compensator comprising a speed command circuit sending a speed command signal patterned upon signals for lifting and lowering, an automatic speed control amplifier outputting as a torque command signal equal to the difference signal between said speed command signal and a signal proportional to the rotating speed of drive motor of the elevator, a power transducer performing power transduction upon said torque command signal of said control amplifier and controlling the drive motor of the elevator by an output thereof, and a passenger cage hoisted up and down by the drive motor of said elevator, characterized in that in response to said load detection signal and said lifting and lowering command signal, a static frictional torque is determined by the magnitude of the load and the direction of hoisting, a static frictional a torque compensation signal corresponding to said statical friction torque is provided and added to said torque command signal.

In an embodiment of the present invention, load proportional to the passenger load is detected by a load detection section prior to starting of the elevator, and a load detection signal is input to a static frictional torque compensation section. Then, when the signal of lifting or lowering of the elevator is supplied to the torque compensation section, the static frictional torque predetermined for the load detection signal for lifting or lowering is added to the torque command signal, thereby causing the motor via a power transducing element to generate starting torque compensating for the static frictional torque.

As will be appreciated from the above description, according to the present invention, the start torque includes compensation for the passenger load and the static frictional torque, and there is almost no delay between the rise of the speed command and the rise of the actual speed. Moreover, if the shape of the speed pattern is suitably selected, a start characteristic having very smooth acceleration can be obtained.

These and other objects, features and advantages of the present invention will become more apparent in light of the following detailed description of an exemplary embodiment thereof.

BEST MODE FOR CARRYING OUT THE INVENTION

Figure 1:
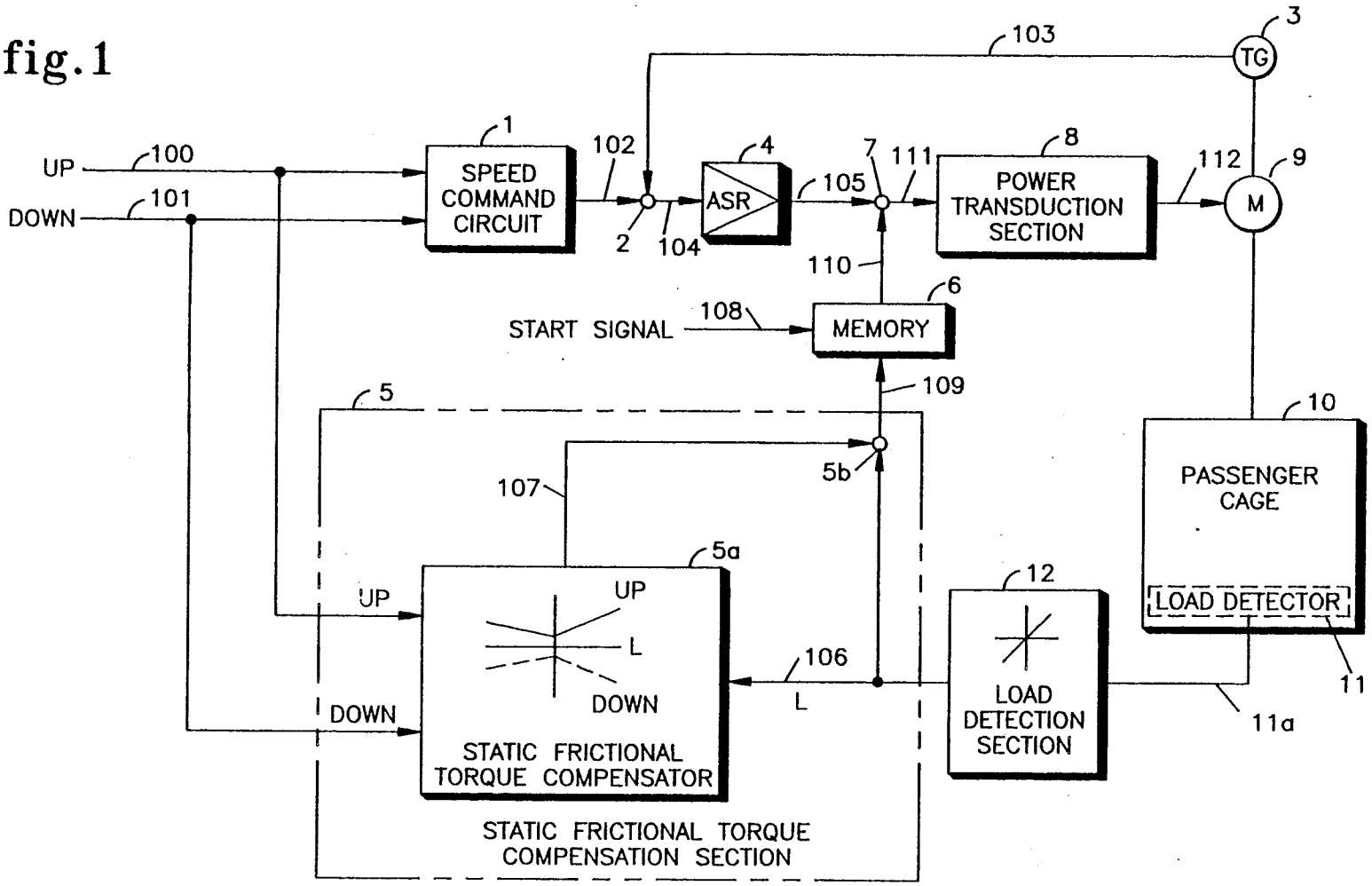
FIGS. 1 through 3 are views showing various aspects of the present invention.

Now, one embodiment of circuitry according to this invention will be described in connection with FIG. 1. In this figure, numeral 1 designates a speed control command circuit and a speed pattern command signal on a line 102 is supplied from this command circuit 1. To the speed command circuit 1 a travel command signal (UP/DOWN command signal) on a line 100 or 101 is provided for hoisting up and down. Numeral 2 denotes a summing point, and the speed command signal on line 102 from the speed command circuit 1 and a signal 103 proportional to the rotating speed of a tachometer generator (TG) 3 are input thereto. Numeral 4 denotes an automatic speed control amplifier (ASR-AMP), and a summed output signal on a line 104 from the summing point 2 is input to this amplifier 4 while a torque command signal on a line 105 is output from said amplifier 4.

Numeral 5 denotes a static torque compensation section for compensating the static frictional torque of gears, and in the compensator section 5 there is provided a static frictional torque compensator 5*a* to which the UP/DOWN command signals on lines 100, 101 and a load detection signal on a line 106 from a load detection element 12, which is explained later, are input. Within the pictured block 5*a* is a plot of load on the horizontal axis intersected at the 50% (counterweight balance) point by a vertical axis representing static frictional torque. Since the static frictional torque of gears varies with the number of passengers and the moving direction of the cage, the static frictional torque is predetermined for hoisting up (solid line) and down (dotted line) responding to the load detection signal 106, and the static frictional compensator 5*a* outputs a static frictional torque compensation signal on a line 107 selectively in response to the various signals input thereto.

Reference numeral 5*b* designates another summing point, at which the output signal on the line 106 of a load detection section 12 and the static frictional torque compensation signal 107 are summed in order to provide a summed signal on a line 109 to a memory 6. The memory 6 temporarily stores the signal on line 109 and upon start, a starting signal is provided on a line 108 to the memory and the stored signal is then provided on a line 110 to an adder 7 as a compensation signal. The adder 7 receives the torque command signal on line 105 and the compensation signal on line 110 and produces an adder output signal on a line 111.

Numeral 8 designates a power transduction section which is constituted, for example, by an inverter. The power transducer 8 performs a gate control or the like in response to the adder output signal on line 111, and a motor drive output signal on a line 112 is obtained therefrom. Numeral 9 designates a motor, and the tach generator (TG) 3 and the passenger cage 10 start moving by actuation of the motor 9. Numeral 11 denotes a load detection element, which detects passenger load in the cage 10. Numeral 12 denotes a load detection section, which detects the load in the passenger cage 10 of the elevator before starting of the elevator, and thusly detected load is kept constant during elevator's traveling.

Now, the operation of this embodiment will be described.

When passengers get into the cage 10, the passenger load is detected by the load detector 11 and a load signal on a line 11*a* is input to the load detection section 12. The load detection section 12 provides the load detection signal 106 corresponding to the load to the static friction torque compensator 5*a* and the summer 5*b*. Then, when the UP signal on line 100 for lifting the elevator is input to the speed command circuit 1 and the static frictional torque compensation section 5, for instance, the speed command signal on line 102 is input from the speed command circuit 1 to the summer 2. The summer 2 receives the speed command signal on line 102 and the sensed speed signal on line 103 from TG 3, produces the collation signal on line 104 which is provided to the ASR amplifier 4, thereby inputting the torque command signal on line 105 to the adder 7. On the other hand, the static frictional torque compensator 5*a* of the static frictional torque compensation section 5 inputs the static frictional torque compensation signal on line 107 corresponding to the load detection signal on line 106 to the summer 5*b*, causing the summer 5 to output the compensation signal on line 109. The memory 6 inputs to said adder 7 the compensation signal on line 110 stored in response to the starting signal on line 108. In the adder 7 the torque command signal on line 105 and the compensation signal on line 110 are added to each other, and the added output signal on line 111 is provided to the power transduction section 8, and from the power transduction section 8 the motor drive output signal on line 112 is provided to the motor 9, causing the motor 9 to generate the starting torque. At this time, if a brake (not shown) such as a motor or a drum is released, the motor 9 produces a torque corresponding to the load and the static frictional torque so as to sustain the passenger cage 10, and the sensed rotating speed signal on line 103 of TG 3 is returned to the collation section 2 upon acceleration, performing control following the speed command signal on line 102 of the speed command circuit 1.

Here, the static frictional torque of the gears varies with the kind of gears, tooth load, and traveling direction of the elevator. Therefore, the static frictional torque compensator 5*a* is chosen as a function of the magnitude of the load and the traveling direction, and it is constructed in such fashion that the size thereof can be adjusted by gear ratio or the like.

Figure 2:
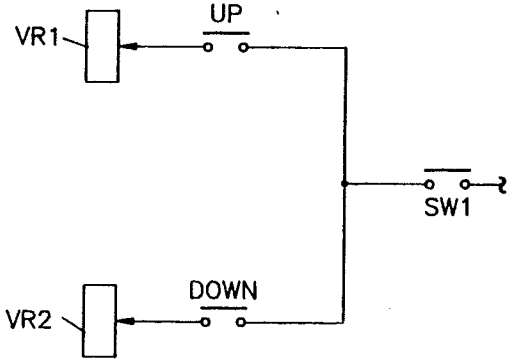
Figure 3:
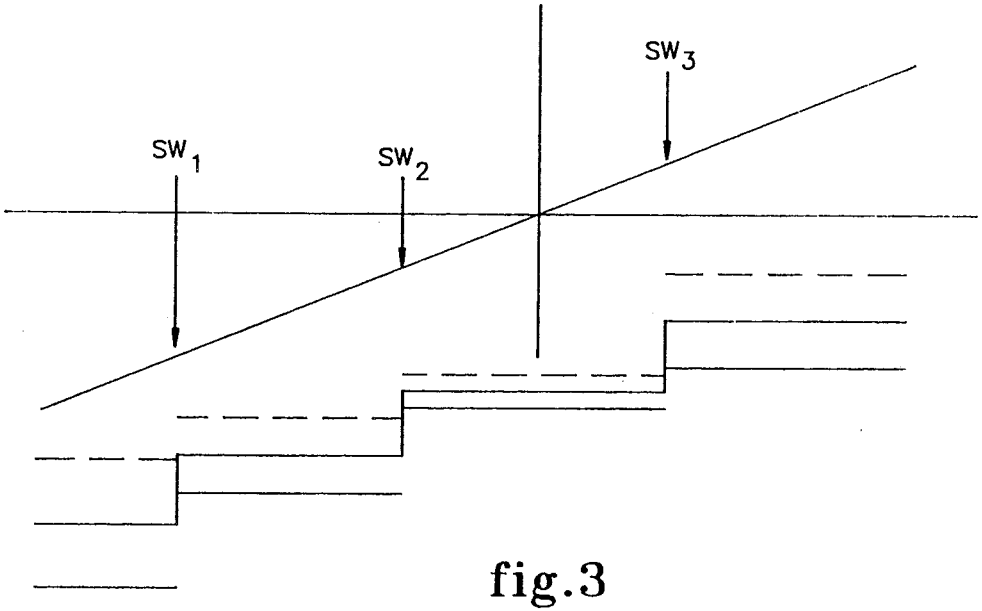
Figure 4:
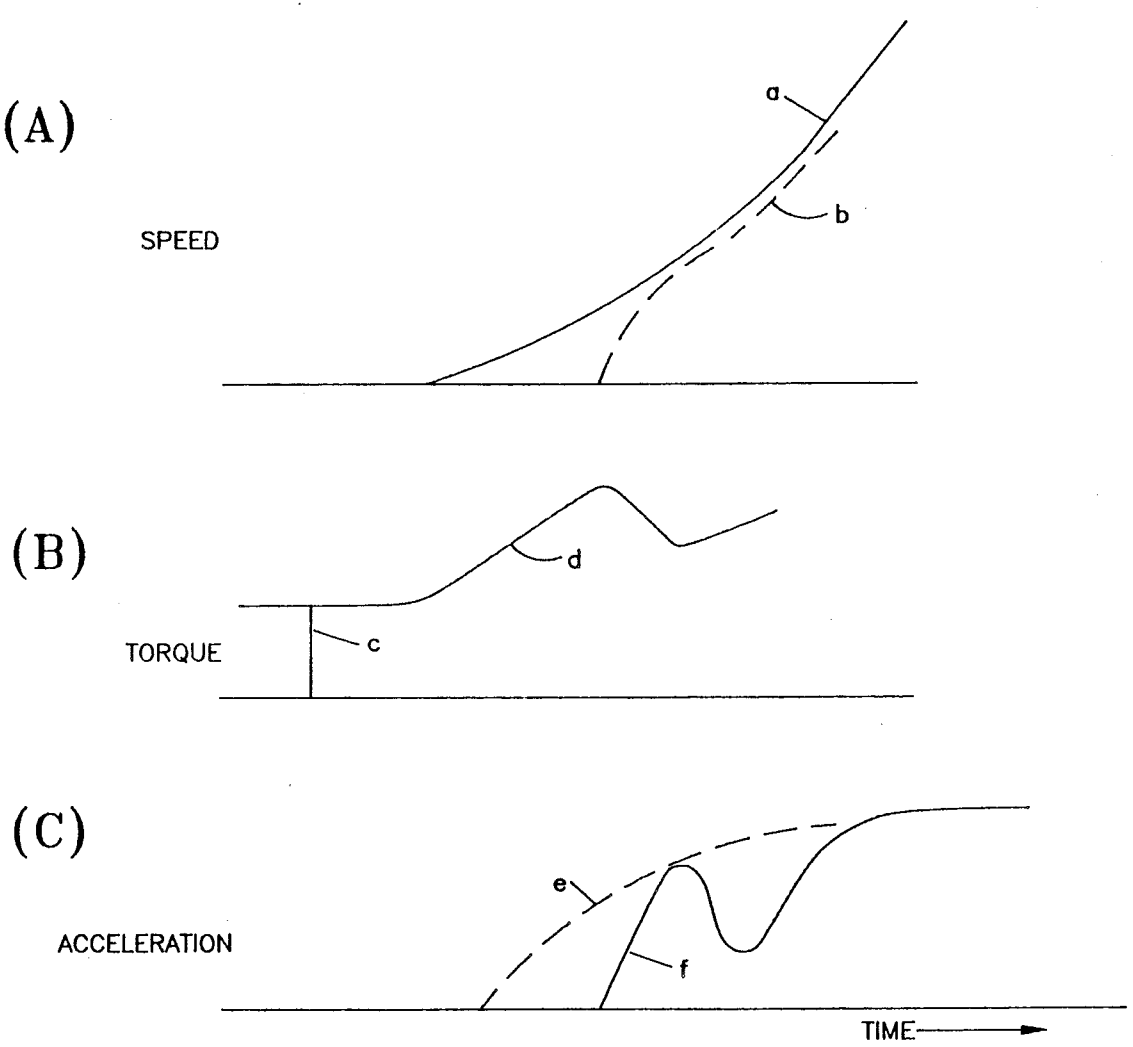
FIGS. 4(A) through 4(C) are views showing characteristics of a prior art start system for an elevator at start.

Furthermore, in detecting the load of the passenger cage 10, in addition to analog detection by the load detection section 12, there are two other ways to detect the load stepwise using a switch circuit FIG. 2 depicts an example of such a switch circuit, and FIG. 3 is a view showing that is is feasible to carry out a stepwise detection by combining switches SW1–SW3 and displacement. In the stepwise load detection, an operating point of the switch determines the load compensation although, the compensation is set in such fashion that the compensation in the UP direction differs from that in the DOWN direction. In FIG. 3, the solid line indicates the desired load corresponding torque while the dotted line indicates the actual torque compensation in UP mode and the two-dot chain line indicates the actual torque compensation in DOWN mode.

As described above, in the start compensation device of this invention, the start torque is a torque including the load compensation and the static frictional torque, and there is almost no delay between the rise of the speed command and the rise of the actual speed. Moreover, according to the system of the present invention, if the configuration of the speed pattern stored in the start torque compensator 5*a* beforehand is suitable, a start characteristic of very smooth acceleration can be obtained In addition, since it is possible that little follow-up delay occurs in the present system, no vibration in the mechanical system is brought about, and the mechanical system can be designed irrespective to the vibration compared with a conventional system. Here, it should be noted that the switch circuit in FIG. 2 employs a variable resistance although, it goes without saying that it is not limited to that and that fixed resistance with respect to the switch can be used. And, when a CPU is utilized in the overall control, operation may be conducted in the CPU, depending on the load.

Although the invention has been shown and described with respect to an exemplary embodiment thereof, it should be understood that the foregoing and other changes, omissions and additions may be made therein and thereto, without departing from the spirit and scope of the invention

We claim:

1. A start compensation device for an elevator motor controller performing start compensation by detecting a load of a passenger cage and adding a compensation signal corresponding to the detected load to a torque command signal, the elevator start compensation device comprising:

a load sensor, for providing a load detection signal indicative of the load upon the elevator car;

a speed sensor for providing a speed signal proportional to a rotating speed of the elevator motor;

a speed command circuit, responsive to direction indicating command signals, for providing a speed command signal for commanding lifting and lowering of the elevator car at a selected speed;

an automatic speed control amplifier, responsive to a signal having a magnitude indicative of a difference between said speed command signal and said speed signal, for providing a torque command signal;

a static frictional torque compensator, responsive to said load detection signal and to said direction indicating command signals, for determining a static frictional torque according to the magnitude of the load and the direction of hoisting, for providing a compensation signal corresponding to said static frictional torque;

a first summing means for adding said load detection signal to said compensation signal and providing a load-boosted compensation signal; and a second summing means for adding said load-boosted signal to said torque command signal and providing a load-boosted compensated torque signal for driving said elevator motor.

* * * * *